US006913223B2

(12) United States Patent
Heinonen

(10) Patent No.: US 6,913,223 B2
(45) Date of Patent: Jul. 5, 2005

(54) PAPER MACHINE REEL-UP WITH REEL NIP LOADING MEASUREMENT

(75) Inventor: Mikko P. Heinonen, Appleton, WI (US)

(73) Assignee: Metso Paper, Inc., Helsinki (FI)

( * ) Notice: Subject to any disclaimer, the term of this patent is extended or adjusted under 35 U.S.C. 154(b) by 6 days.

(21) Appl. No.: 10/630,362

(22) Filed: Jul. 30, 2003

(65) Prior Publication Data

US 2005/0023407 A1 Feb. 3, 2005

(51) Int. Cl.[7] ..... B65M 18/14

(52) U.S. Cl. ..... 242/541.7; 242/541.4; 242/542.3

(58) Field of Search ..... 242/541.4, 541.7, 242/542.3

(56) References Cited

U.S. PATENT DOCUMENTS

| | | | | |
|---|---|---|---|---|
| 3,306,547 A | | 2/1967 | Reid et al. | |
| 3,877,654 A | * | 4/1975 | Randpalu et al. | 242/533.1 |
| 4,549,701 A | | 10/1985 | Lucas | |
| 4,742,968 A | | 5/1988 | Young, Jr. et al. | |
| 5,048,353 A | | 9/1991 | Justus | |
| 5,106,029 A | * | 4/1992 | Ehrola | 242/541.7 |
| 5,370,327 A | | 12/1994 | Adamski | |
| 5,375,790 A | * | 12/1994 | Svanqvist | 242/541.1 |
| 5,379,652 A | | 1/1995 | Allonen | |
| 5,383,371 A | | 1/1995 | Laitinen | |
| 5,592,875 A | | 1/1997 | Moschel | |
| 5,611,500 A | | 3/1997 | Smith | |
| 5,699,729 A | | 12/1997 | Moschel | |
| 6,036,137 A | * | 3/2000 | Myren | 242/541.7 |
| 6,325,323 B1 | * | 12/2001 | Olsson | 242/541.7 |
| 6,550,713 B1 | * | 4/2003 | Ruha et al. | 242/541.7 |
| 6,669,819 B2 | * | 12/2003 | Mausser et al. | 162/283 |
| 6,705,561 B2 | * | 3/2004 | Mausser et al. | 242/541.1 |

* cited by examiner

*Primary Examiner*—Kathy Matecki
*Assistant Examiner*—Sang Kim
(74) *Attorney, Agent, or Firm*—Stiennon & Stiennon

(57) ABSTRACT

A reel-up having pivoting first members mounted on carriages where the first members engage the bearing housings of a reel spool. The first members are mounted between stops which limit their maximum deflection. A load cell is positioned on each carriage, the pivoting first members being between the load cell and the reel spool bearing housings. The load cells and the flexibility of the pivoting first members are selected so that each first member bottoms out on a stop before the load cell is subjected to more than its design load.

9 Claims, 1 Drawing Sheet

PAPER MACHINE REEL-UP WITH REEL NIP LOADING MEASUREMENT

BACKGROUND OF THE INVENTION

The present invention relates to reel-ups which operate on papermaking machines in general, and more particularly to force sensors which measure the nip loading between a reeling cylinder and a forming paper parent reel.

Paper which is made on a papermaking machine is wound up into reels which are periodically removed from the papermaking machine for further processing. The reels are large, sometimes 10 m in length and 3 or 4 m in diameter and weighing over 120 tons. To maintain the quality of the paper wound into the reel, the formation of the reel must be carefully controlled. There are three primary factors which control the quality of the reel formed, these are: the web tension, the center wind assist torque, and—most importantly—the nip loading between the paper reel and the reeling cylinder. The reeling cylinder is a roll drum which is normally driven and which is positioned just before the reel. The paper web typically wraps part of the reeling cylinder and then enters a nip formed between the reeling cylinder and a forming paper reel, and is wound onto the paper reel. It is the loading of this nip formed between the reeling cylinder and the paper reel which must be controlled to maximize the quality of the paper reel formed. The nip loading will typically be varied, typically decreasing in magnitude as the size of the paper reel increases.

The reel-up process begins with an empty spool or reel core which is brought down from a storage unit positioned above the reeling cylinder and into engagement with the reeling cylinder—typically on a pair of rotating arms which terminate in forks which extend on either side of the reel core bearings. The web is transferred from a fully formed paper reel to the empty spool or reel core in a process known as the reel change-over. Immediately, or once the paper reel has reached a given size, the roll spool is positioned between a pair of carriages which ride on level rails. The reel spool rotates freely on bearings contained within bearing housings. The bearing housings in turn are supported by the carriages which are movable on the horizontal rails. Web tension is controlled by the reeling cylinder, and torque is applied to the reel spool via center wind assist. Nip load is controlled by hydraulic cylinders which position the carriages on which the bearing housings and thus the paper reel are supported. The hydraulic cylinders adjust the position of the paper reel to control the nip loading of the paper reel with the reeling cylinder. Nip pressure may be monitored by monitoring the pressure in the hydraulic cylinders which position the carriages. More recently, load cells have been incorporated in the pins which join the hydraulic cylinders to the carriages. Although the use of load cells is superior to measuring hydraulic cylinder pressure, the use of load cells would benefit from more accurate determination of nip loading. What is needed is a load cell arrangement where load cells of smaller range and more accurate output can be used.

SUMMARY OF THE INVENTION

The reel-up of this invention employs pivoting arms mounted on a carriage which engages the bearing housings of a reel spool. The arms are mounted between stops so the maximum deflection of the pivoting arms is limited by the stops. A load cell is positioned on the carriage with a pivoting arm between the load cell and the reel spool bearing housings. The load cell, and the flexibility of the pivot arm are selected so that the pivot arm bottoms out on a stop before the load cell is subjected to more than its design load. In prior art designs the load cell was considerably over designed because it could be subjected to loads many times higher than the nip loading forces. Because load cell accuracy is a fraction of total load cell range, nip loading suffered from a lack of accuracy because only a small percentage of the load cell's range was employed during normal nip loading. The load cell of the current invention is selected to have a range up to only the maximum nip load used by the reel-up.

It is a feature of the present invention to provide a reel-up which forms paper reels of improved quality.

It is another feature the present invention to provide a reel-up which can more precisely control the nip pressure used in forming the paper reel.

Further objects, features and advantages of the invention will be apparent from the following detailed description when taken in conjunction with the accompanying drawings.

DESCRIPTION OF THE PREFERRED EMBODIMENTS

Figure 1:
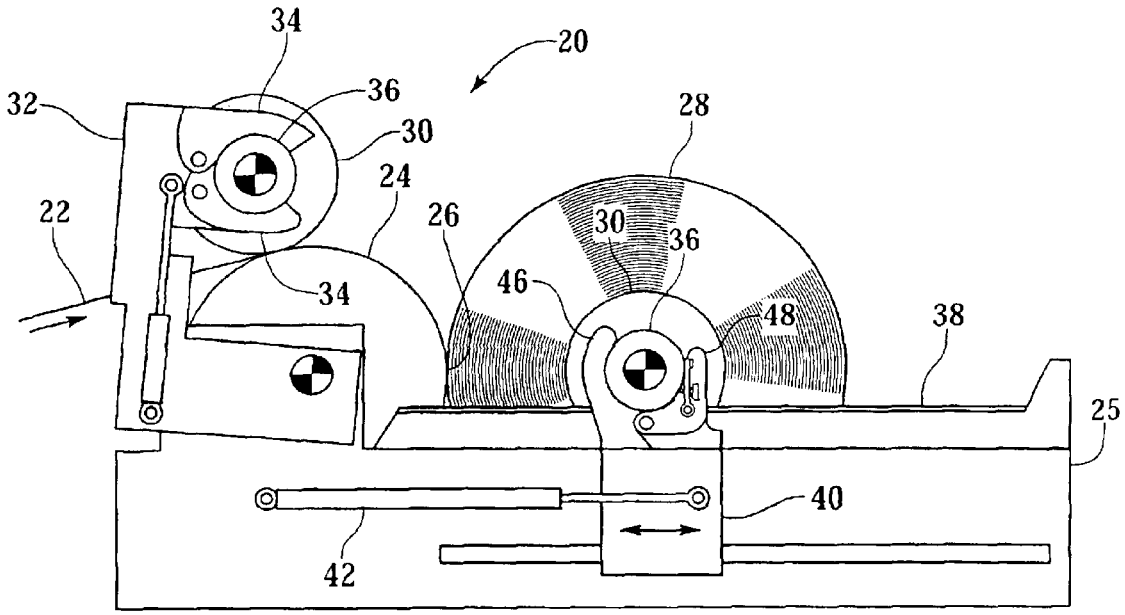
FIG. 1 is simplified side elevational view of a paper reel-up incorporating the load cell mounting arrangement of this invention.
Figure 2:
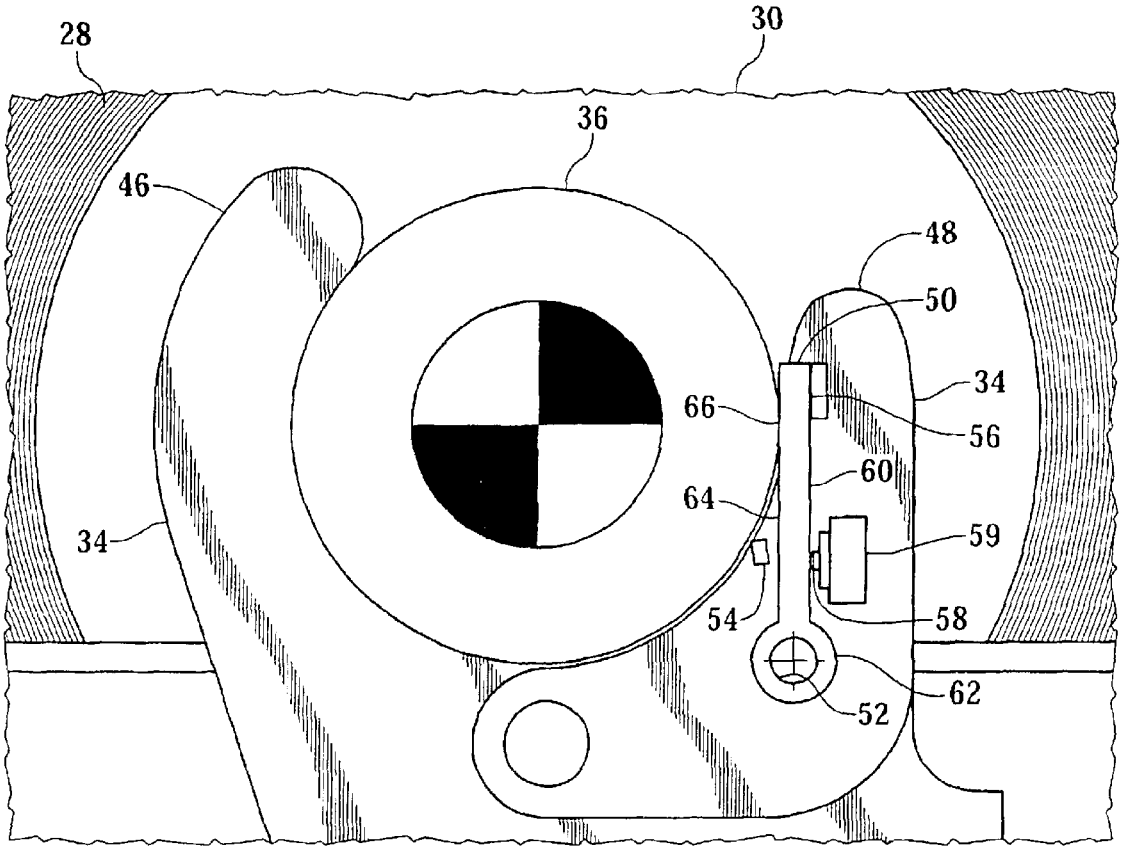
FIG. 2 is a detailed view of the load cell mounting arrangement of FIG. 1.

Referring more particularly to FIGS. 1–2, wherein like numbers refer to similar parts, a reel-up 20 is shown in FIG. 1. The reel-up 20 receives a paper web 22 from a papermaking machine (not shown) which travels over the reeling cylinder 24 mounted reel-up frame 25 to a nip 26 formed with a parent reel 28. The paper web 22 is then wound on to the parent reel 28. The parent reel 28 is formed about a reel spool 30 which is moved from a reel spool storage (not shown) into engagement with the reeling cylinder 24 between a pair of primary arms 32. Although only one primary arm 32 is shown in the figures, it will be understood that the structures described herein will be substantially duplicated with respect to the front and back of the reel-up 20. The primary arms 32 have opposed grippers 34 which hold the reel spool bearing housings 36.

The primary arms 32 transport the reel spool 30 to horizontal support rails 38, shown in FIG. 1, where the bearing housings 36 are received by carriages 40. The position of the carriages 40 is controlled by hydraulic actuators 42 which position the reel spool 30 with respect to the reeling cylinder 24, and directly control the nip pressure formed in the nip 26 between the forming parent roll 28 and the reeling cylinder 24.

Each carriage 40 has a first arm 46 and a second arm 48 which together engage a roll bearing housing 36 which carries the reel spool 30. The first arm 46 is on the side of the reel spool 30 facing the reeling cylinder 24, while the second arm 48 is on the opposite side of the reel spool. The reel spool 30 is held on the carriages by the roll bearing housings 36 between first arms 46, and second arms 48 which are positioned opposite the first arms 46. The operation of a carriage with arms that engage a roll bearing housing is described more fully in U.S. Pat. No. 6,036,137 to Myren and U.S. Pat. No. 6,550,713 to Ruha et al. which are incorporated herein by reference.

As best shown in FIG. 2, each second arm 48 incorporates a rotating first member 50 which is mounted by a pivot bearing 52 to the carriage 40. Each rotating first member 50 extends upwardly from a pivot 52 between an upstream stop 54 mounted to the structure of the second arm 48 and a downstream stop 56 also mounted to the structure of the second arm 48. A load cell 58 is mounted to a bracket 59 on the second carriage arm 48 opposite the downstream side 60 of the rotating first member 50.

When the parent reel 28 is urged against the reeling cylinder 24 by the operation of the hydraulic actuators 42 a force is applied at the nip 26. The force applied at the nip 26 is nearly identical to the force applied to the first members 50. The weight of the parent reel 28 is supported by the bearing housings 36 on the support rails 38. And the only lateral force applied to the parent reel 28 is where the first members 50 engage the roll bearing housings 36. Hence it is possible to determine the nip force by determining the force on the load cells 58 positioned on the second arm 48.

Each load cell 58 is positioned to be engaged by a rotating first member 50 as the member 50 moves toward the downstream stop 56. Load cells are typically designed with relatively little deflection so that deflection of the load cell does not affect the mechanical properties of the mechanical system in which it is incorporated. Thus a load cell can be used to replace a substantially rigid support, or is designed to replace a pin or a bolt in a mechanical linkage while preserving the properties of the bolt or support which deflect little under load. Although the stiffness of the load cell is an advantage in designing load cells into structures, this feature has the disadvantage that if the structure is subjected to transitory loads caused, for example, by one part hitting or coming to a sudden stop against another, the capabilities of the load cell must be large or the limits of the load cell may be exceeded by the transitory loads, this can have detrimental effects on the reliability and accuracy of the load cell.

The rotating first member 50 is used to limit the loading on the load cell 58. The rotating first member 50 has a pivot base 62 with a cantilevered beam 64 extending from the base. The cantilevered beam 64 extends between the pivot base 62 which is mounted to the pivot 52 and the reel spool bearing housing 36 or the downstream stop 56. By design choice, the cantilevered beam 64 forms a flexible member or flexible portion of the rotating member, which portion has a selected amount of beam flexure so as to allow significant deflection of the beam 64 as the load cell 58 is loaded. The beam 64 is designed with a spring constant such that elastic deflection of the beam between the point when the beam 64 first engages the load cell 58 and where the beam 64 engages the downstream stop 56 produces a force on the load cell which is less than its maximum load measuring capability or range. The downstream stop 56 together with the position of the load cell 58 sets the maximum deflection to which the cantilevered beam 64 of the rotating first member 50 can be subjected. The maximum deflection of the cantilevered beam 64 in turn sets the maximum load which can be applied to the load cell 58. The cantilevered beam 64 can apply a certain amount of mechanical advantage depending on the position of the load cell between the pivot 52 and the roll bearing housing 36 contact point 66. For example, if the load cell is positioned halfway between the contact point 66 and the pivot 52, the force applied by the first member 50 to the load cell 58 would be twice that applied to the bearing housing 36.

In one known application of a load cell used to measure paper reel nip load, a 100 kN measuring load cell is used to measure a loading force of about 8 kN. The prior art load cell is incorporated in the pin conection where the hydraulic actuator 42 joins the carriage 40. If the load cell drifts even 1 percent a considerable error, of about 10 percent in the measured nip force will result. The load cell 58 can have a maximum range which approximately matches or is slight greater than the applied load. Depending on the mechanical advantage applied by the rotating first member 50, the load cell could be a range of values, but in all cases because the applied load is matched to the load cell maximum range, load cell drift will be considerably smaller in proportion to the total load measured. Another problem is that friction of the linear bearing where the carriage 40 slides on the horizontal support rails 38 also affects the load in the nip 26, however the output of the prior art load cell located between the hydraulic actuator 42 and the carriage 40 does not measure the carriage friction loads. The location of the load cell 58 of this invention measures the forces applied directly to the roll bearing housings of the reel spool which includes the force of the hydraulic actuators 42 and the carriage friction loads.

Accurate measurement of nip force loads is particularly important with paper grades that cannot handle high nip loading, such as tissue paper and release paper. Another advantage of the load cell 58 and its mounting position is that less disassembly of the carriage 40 is required to change a damaged or defective load cell. Measurement of the zero point and gain for the sensor is easier to check and adjust because the sensor is not part of the basic carriage structure.

It should be understood that the load cell arrangement described hearin could be used with a wide range of reel-up designs, but may be particularly advantageously used with those designs sold under the trademarks OptiReel™, and OptiReel™, M model, sold by Metso Paper, Inc., but could be used with the Beloit style TNT reel such as disclosed in U.S. Pat. No. 5,370,327, or conventional Pope style reels or ValReel™ available from Metso Paper, Inc. where the carriage which holds the reel spool may be fixedly mounted to pivoting arms. For example the primary arms 32, which terminate in two grippers 34 can be considered carriages and could incorporate the load measuring structure of this invention. It should be understood that the load cell 58 could be of any design which meets the required performance criteria, for example, model LBM series load buttons available from Interface, Inc. of Scottsdale, Ariz., can be used.

It is understood that the invention is not limited to the particular construction and arrangement of parts herein illustrated and described, but embraces all such modified forms thereof as come within the scope of the following claims.

I claim:

1. A reel-up comprising:

a reel-up frame;

a reeling cylinder mounted on the reel-up frame;

two carriages mounted for motion on the reel-up frame;

a reel spool mounted between the two carriages, each carriage having an arm which is positioned in a downstream direction from the reel spool, the two carriages are movable to urge the arm on each of the two carriages toward the reel spool, and to urge the reel spool toward the reeling cylinder to form a nip therewith;

a first member, mounted to each of the two carriages, the first member having flexible portions of a selected spring constant, wherein the first members are positioned on the two carriages to engage the reel spool, each first member movable toward the arm of each carriage, and each first member being limited in its motion toward the arm of each carnage by a first stop mounted to the at least one arm; and a load cell, having a maximum load limit, mounted on each of the at least one arm so that during motion of the first member toward the at least one arm, the flexible portion of each of the first members engages the load cell, and wherein the first member, the load cell, and the stop are arranged so that when the first member is engaged with the stop, the selected spring constant of the flexible portion is such that the loading applied to the load cell is less than the maximum load limit of the load cell.

2. The reel-up of claim 1 wherein the first member forms a pivot arm which is pivotally mounted by a pivot base to a pivot bearing on the carriage, and the pivoting arm is formed by a flexible cantilever beam which extends from the pivot base and is engageable with the stop and the load cell, and wherein the pivoting arm is positioned between the load cell and the reel spool.

3. The reel-up of claim 2 further comprising a second stop mounted to the carriage upstream of the first member to prevent the first member from pivoting in the upstream direction.

4. The reel-up of claim 1 further comprising a pair of parallel rails, and wherein said at least two carriages are mounted for motion on said pair of parallel rails.

5. A method of measuring the load applied to a nip between a forming paper reel and a reeling cylinder, comprising the steps of:

forming the paper reel on a reel spool;

supporting the reel spool between a pair of spaced apart carriages;

moving the paper reel mounted on the pair of spaced apart carriages into engagement with the reel cylinder and forming the nip between the reel cylinder and the forming paper reel;

pressing on the reel spool by engaging the reel spool with first members mounted on each carriage, each first member having flexible portions having a selected spring constant, and each first member being mounted to one of said two carriages for motion toward a stop, the reel spool being thereby urged against the reel cylinder to define the nip; and measuring the force applied to the defined nip with a load cell mounted on each carriage, the load cells having a selected maximum capability, and each load cell being mounted so as to be engaged by one of the first members, wherein a maximum load with which the first member can engage the load cell is controlled by the selected spring constant of the flexible portions of the first members and the stops mounted on the carriages, so that when the stop is engaged by the first member the flexible portions are engaging the load cell at a load which is less than the selected maximum capability of the load cell.

6. The method of claim 5 wherein the spring constant is selected to control the maximum load with which the first members can engage the load cells to be approximately the maximum range of the load cell.

7. The method of claim 5 wherein the first members are pivotally mounted to the carriages, and pivot toward the stop as the carriages press against the reel spool, wherein the flexible portions of each of the first members is formed by a flexible beam which extends between a pivot base and the stop, the flexible beam having the selected spring constant, and engaging the load cell positioned on the carnage between the pivot mount and the stop.

8. A method of measuring the forces in a reel-up comprising the steps of:

urging a loading member mounted to a reel-up frame against a reel spool, with a first selected force to urge the reel spool towards a reeling cylinder, the loading member being mechanically arranged to apply to a load cell mounted on the reel-up frame a force proportional to the first selected force applied to the reel spool;

selecting the loading member so that a portion of the loading member has a selected spring constant, so that the portion of the selected member deflects under load, so that as the loading member engages and loads the reel spool urging it towards the reeling cylinder, the loading member portion having the selected spring constant deforms elastically until it engages a stop mounted on the reel-up frame, the selected spring constant being selected to control the maximum load on the load cell when the loading member is engaged with the stop.

9. The method of claim 7 wherein the spring constant is selected to control the maximum load with which the first members can engage the load cells to be approximately the maximum range of the load cell.

* * * * *

UNITED STATES PATENT AND TRADEMARK OFFICE

CERTIFICATE OF CORRECTION

PATENT NO. : 6,913,223 B2
DATED : July 5, 2005
INVENTOR(S) : Mikko Heinonen

It is certified that error appears in the above-identified patent and that said Letters Patent is hereby corrected as shown below:

Column 5,
Line 15, “a pivot arm” should be -- a pivoting arm --.

Column 6,
Line 21, “carnage” should be -- carriage --.

Signed and Sealed this

Thirtieth Day of August, 2005

JON W. DUDAS
*Director of the United States Patent and Trademark Office*